US008912485B2

(12) United States Patent
Maier et al.

(10) Patent No.: US 8,912,485 B2
(45) Date of Patent: Dec. 16, 2014

(54) ACQUISITION TECHNIQUE FOR MALDI TIME-OF-FLIGHT MASS SPECTRA

(75) Inventors: Thomas Maier, Lilienthal (DE); Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 212 days.

(21) Appl. No.: 13/103,672

(22) Filed: May 9, 2011

(65) Prior Publication Data

US 2011/0272573 A1 Nov. 10, 2011

(30) Foreign Application Priority Data

May 7, 2010 (DE) ..... 10 2010 019 857

(51) Int. Cl.
*H01J 49/00* (2006.01)
*H01J 49/16* (2006.01)
*H01J 49/40* (2006.01)

(52) U.S. Cl.
CPC ..... *H01J 49/0027* (2013.01); *H01J 49/164* (2013.01); *H01J 49/40* (2013.01)
USPC ..... 250/282; 250/281; 250/288

(58) Field of Classification Search
USPC ..... 250/281, 282, 283, 286, 287, 288
See application file for complete search history.

(56) References Cited

U.S. PATENT DOCUMENTS

| | | | | |
|---|---|---|---|---|
| 7,385,192 | B2 | 6/2008 | Haase et al. | |
| 2005/0023456 | A1 | 2/2005 | Frechet et al. | |
| 2006/0284069 | A1* | 12/2006 | Le Blanc | 250/282 |
| 2009/0206247 | A1 | 8/2009 | Holle | |
| 2010/0248298 | A1 | 9/2010 | Kostrzewa et al. | |
| 2011/0275113 | A1* | 11/2011 | Kostrzewa et al. | 435/34 |

OTHER PUBLICATIONS

Holle et al., "Optimizing UV laser focus Profiles for improved MALDI performance", May 22, 2006, Journal of Mass Spectrometry, vol. 41, pp. 705-716.*

* cited by examiner

*Primary Examiner* — Nicole Ippolito
*Assistant Examiner* — Hanway Chang
(74) *Attorney, Agent, or Firm* — O'Shea Getz P.C.

(57) ABSTRACT

The invention relates to acquisition techniques for time-of-flight mass spectra with ionization of the analyte substances by matrix assisted laser desorption. Generally speaking, these acquisition techniques involve adding together a large number of individual time-of-flight spectra, each with restricted dynamic measuring range, to form a sum spectrum. The invention provides a method that improves, in particular, the reproducibility, the concentration accuracy and therefore the ability to quantify the mass spectra. Particular embodiments also increase the dynamic range of measurement. For this purpose, multiple series of mass spectra are acquired, whereby the energy density in the laser spot is increased in discrete steps. As a result, many ion signals saturate the detector and can therefore no longer be evaluated. However, it is possible to employ a technique in which the ion beam is increasingly defocused, or, secondly, to replace parts of the spectrum that are subject to saturation by intensity extrapolations from mass spectra acquired with lower energy density. In the first case, hundreds or thousands of individual mass spectra must be added together in order to increase the dynamic measuring range. In the second case, the finally acquired mass spectrum, with its replacements, forms a mass spectrum with a high dynamic measuring range, improved reproducibility and better concentration accuracy. The gradient of the increasing intensities of the ion signals, as a function of the energy density, supplies additional information about the proton affinity of the analyte ions. The concentration accuracy is enhanced because the increase in the number of proton donors in the ionization plasma leads to an increase in the ionization of those analyte substances that have a lower proton affinity.

17 Claims, 4 Drawing Sheets

ACQUISITION TECHNIQUE FOR MALDI TIME-OF-FLIGHT MASS SPECTRA

PRIORITY INFORMATION

This patent application claims priority from German Patent Application 10 2010 019 857.9 filed on May 7, 2010, which is hereby incorporated by reference.

FIELD OF THE INVENTION

The invention relates to acquisition techniques for time-of-flight mass spectra with ionization of the analyte substances by matrix assisted laser desorption. These acquisition techniques involve the addition of individual time-of-flight spectra, each with restricted dynamic measuring range, to form a sum spectrum.

BACKGROUND OF THE INVENTION

Time-of-flight mass spectrometers rapidly acquire a sequence of individual time-of-flight spectra. However, to avoid saturation effects for the most intense ion signals within the spectrum, the spectra must only contain a few hundred ions at most, and therefore they have a lot of empty mass ranges and are highly scattered. For substances whose concentration is low, an ion is only measured in every tenth, hundredth or even thousandth individual time-of-flight spectrum. Hundreds or even thousands of these individual time-of-flight spectra, which at present can be acquired at frequencies of up to two thousand spectra per second, are then immediately processed to create a sum spectrum in order to obtain usable time-of-flight spectra with a large dynamic measurement range for the ion species of the various analyte substances. When the term "mass spectrum" is used in this document, this designates this sum spectrum. Nowadays between 50 and 5000 individual spectra, depending on the dynamic range of measurement required, are regularly added together to form a mass spectrum.

The term "ion signal" here refers to the part of a mass spectrum that contains "identical ions". This calls for a closer definition of the term "identical ions". In a mass spectrometer with ultra-high resolution, an ion signal only contains ions comprised of the same isotopes; ions with a different isotopic composition, even if they have the same nominal mass, can generally be separately measured, and form a different ion signal. In a mass spectrometer that "only" offers high resolution, an ion signal may contain all the ions with the same nominal mass; those ions whose isotopic composition results in different nominal masses form separate ion signals, even in the mass range of some thousands of daltons. In lower-resolution mass spectrometers, an ion signal, particularly in the high-mass range, can encompass all the ions with the same constituent elements i.e. all the ions that have the same molecular formula. The envelope of the isotopic distribution is then measured as the ion signal. An ion signal is also referred to as an "ion peak".

In particular, time-of-flight mass spectrometers operated in linear mode, which measure organic ions with masses in the range of some thousands of daltons, can no longer resolve the isotopic signals of different nominal masses. The ion signals therefore here comprise all the ions in the isotopic distribution, i.e. all the ions with the same molecular formula; the ion signal has essentially the shape of the envelope of the isotopic distribution. FIGS. 1, 2 and 3 illustrate three such distributions of the isotopic signals over the nominal masses for singly charged protein ions with masses of 5000, 12,000 and 20,000 daltons. On the other hand, good time-of-flight mass spectrometers operating in reflector mode achieve mass resolutions of $R=m/\Delta m=40{,}000$; generally speaking they can then resolve ion signals of different nominal masses, and the isotope distributions of FIGS. 1 to 3 therefore appear resolved according to nominal masses.

In order to measure the time-of-flight mass spectra, the electrical currents created at the ion detector by the ions after they have passed through the flight path are first amplified by secondary electron multipliers by factors between $10^5$ and $10^7$, and are then sampled using special digitization units known as "transient recorders". These units contain very fast analog-to-digital converters (ADC); nowadays they operate with sampling rates of around 4 gigasamples per second (GS/s), and higher sampling rates of up to around 10 gigasamples per second are at present under development. The limit to the sampling rate results at present not from the ADC itself, but from the further processing of the measured values to generate an averaged or summed mass spectrum. Usually each measurement is only digitized to a depth of eight bits, therefore only encompassing values between 0 and 255; a good dynamic range of measurement covering five or six orders of magnitude can therefore only be achieved by summing hundreds or thousands of individual spectra into a mass spectrum. Even if it became possible in the future to raise the digitization depth of the ADC to ten or even twelve bits, it would still be necessary to add together many hundreds of or thousands individual spectra in order to obtain a mass spectrum with a sufficiently high dynamic measuring range of four to six orders of magnitude.

For this acquisition technique it is obvious that the ion detector must, on the one hand, register every single ion, but on the other hand must also deliver the highest possible dynamic range of measurement in each individual spectrum. Furthermore, in the individual time-of-flight spectra, the analog-to-digital converter must not become saturated for any of the ion signals, and the ion current must therefore be limited. In order not to lose any ions, but at the same time to achieve a wide measuring range, the amplification provided by the secondary electron multiplier must be adjusted very accurately. Methods for optimum adjustment of the amplification of the secondary electron multiplier are disclosed in U.S. Published Application 20090206247. Because of the Poisson distribution of the secondary electrons generated by the impact of an ion, it is favorable for a single ion to yield a signal that generates a mean measured value of at least about 2 or 3 counts in the ADC. This, however, restricts the intensity dynamic range within an individual time-of-flight spectrum to about two orders of magnitude: from around 2.5 counts up to 255 counts. Only a few percent of individual ions, however, are lost with this adjustment.

This optimum adjustment of the secondary electron multiplier, however, only applies to ions of a selected mass-to-charge ratio m/z, since the sensitivity of the secondary electron multiplier depends on the mass, and declines in approximate proportion to $1/\sqrt{(m/z)}$. If the amplification of the secondary electron multiplier is adjusted, for instance, in such a way that the 2 or 3 counts mentioned above are achieved for a singly charged ion with a mass m=20,000 daltons, in order that no ions of high mass are lost, then a singly charged ion with a mass m=2000 daltons will already yield 8 counts, and the measuring range for ions of this mass is restricted to merely one and a half orders of magnitude between 8 and 255 counts.

Restricting the ion current in order to avoid saturation effects is, however, not always without difficulty; the restriction can itself also have very unfavorable effects. In the case, for instance, of the ionization of analyte molecules by matrix-assisted laser desorption under consideration here, not all the analyte molecules are ionized to the same degree if the laser energy is reduced for the sake of a reduced ion current. Analyte molecules with low proton affinity are not ionized unless the energy density of the laser light pulse in the laser spot on the sample preparation is high enough. Then, however, many ion signals may already be saturated. These problems occur in particular when analyzing protein mixtures. If, for analytic reasons, it is required to ensure that all the proteins in the mixture have about the same probability of being ionized, it is necessary to generate a high energy density within the laser spot. With today's acquisition techniques it is not usually possible to achieve this, since it would then cause many ion signals to reach saturation.

At the place where the laser light is focused on the sample, the "laser spot", a plasma consisting of heated, vaporized matrix substance is formed by every laser shot. Each sample consists of tiny crystals of the matrix substance, in which the protein molecules are embedded at very low concentrations on the scale of a hundredth of a percent or lower. The plasma very quickly reaches a maximum temperature, and then cools down again very quickly through adiabatic expansion into the surrounding vacuum. As in any hot plasma, some of the molecules of the matrix substance are ionized in this plasma. The matrix substances are selected in such a way that their ions easily donate protons to the much larger protein molecules that have a higher proton affinity. If, as a result of a lower energy density in the laser spot, the plasma generated is only moderately hot, not enough proton donors are present to ionize all the protein molecules; a competitive situation develops, in which some proteins are favored due to their higher proton affinity while others are disadvantaged. It is recognized that there are real "killer substances" for MALDI, whose inclusion can suppress the ion signals from other substances.

The number of ions in the plasma depends heavily on the maximum temperature reached. Investigations can be found in the literature that show that the number of analyte ions in the plasma rises, over a wide range of energies, with the sixth or even the seventh power of the energy density in the laser spot. Practical experience in the use of MALDI mass spectrometers confirms this observation: the ion current from the analyte molecules rises by six or seven percent when the energy density in the laser spot is raised by one percent. However, if the energy density is simply increased while using the usual sizes of laser spot, so many ions are created by each laser light shot that the ion detector goes into saturation for many of the ion signals in an individual spectrum. As a result, a good (sum) mass spectrum cannot be generated, in addition to which many of the signals that have gone into saturation become so wide that it is no longer possible to tell whether they represent one signal from a single ion species, or whether perhaps they are hiding the signals from two, three or four ion species.

MALDI therefore entails a dilemma between, on the one hand, avoiding saturated signals and, on the other hand, ionizing all the substances in a mixture equally.

Modern laser systems such as the "Smart Beam" laser from Bruker Daltonik GmbH, Bremen, may offer an improvement here even if they cannot provide a complete remedy. At every shot, these laser systems can generate either one or more laser spots with a very small diameter; and because of the small area, only a limited number of ions are delivered, even at high energy density in the laser spot. The duration of the laser light pulses is also optimized to provide the highest ion yield. Laser light pulses from these lasers vaporize extremely little material, but the ionization yield is high, and there is a high probability that molecules with low proton affinity become ionized. But even here, under optimum ionization conditions for the protein molecules, a large number of signals still become saturated.

The acquisition technique used until now is illustrated here with the example of a method used for the identification of microorganisms. The microorganisms, or "microbes" for short, are identified through an analysis of their soluble cell components (primarily proteins) in time-of-flight mass spectrometers operated in linear mode and with the ionization by matrix assisted laser desorption mentioned above. Because it is important for this method to reliably detect the proteins that are present on the basis of their ions, even when they are in mixtures with the proteins from other microbes, the dilemma described above is particularly acute here. For this reason, the method is now described in somewhat more detail:

The generation of the mass spectra of the microbial components usually starts from a cleanly separated colony on a solid, typically gelatinous culture medium or from a centrifugal sediment (pellet) extracted from a liquid nutrient medium. Using a small object such as a wooden toothpick, a tiny quantity of microbes is picked up from the selected colony or from the sediment, and placed on the mass spectroscopic sample support. This sample is then sprinkled with an acidified solution of a conventional matrix substance, the purpose of the matrix substance being to assist the later ionization of the microbial components. The acid in the matrix solution now attacks the cell walls and weakens them; the organic solvent penetrates into the microbial cells causing them to burst due to osmotic pressure, so releasing the soluble proteins. The sample is then dried by evaporating the solvent, leading to crystallization of the dissolved matrix material. In this process, soluble protein molecules are embedded, separately from one another, within the matrix crystals. A number of different types of crystalline organic acids, such as HCCA ($\alpha$-cyano-4-hydroxycinnamic acid), can be used as the matrix substance.

Instead of transferring whole microbes with the toothpick, microbes that have been cleaned by washing and centrifuging can also be decomposed in the centrifuge tube; strong acids that break down even hard microbial cell walls can be used here. Centrifuging precipitates out the insoluble components such as cell walls, so that these can no longer interfere with the mass spectrometric analysis. About one microliter of the supernatant decomposition fluid is now applied to the mass spectroscopic sample support, where it is dried. By applying a further coat of a suitable matrix solution and drying once again, the analytic sample is made ready on the sample support, and the protein molecules are embedded in the matrix crystals. These sample preparations with external decomposition give mass spectra that are practically the same as those obtained from the usual preparation process on sample supports. The mass spectra obtained from these decomposition processes are, however, cleaner than the usual preparations performed on the sample supports; they exhibit less interfering background, and are therefore more suitable for detecting the target microbes, even in mixtures with other microbes.

The sample preparations that have been dried on the sample supports, i.e., the matrix crystals with the embedded protein molecules, are then subjected to pulsed UV laser light in the ion source of the mass spectrometer; each pulse of laser light gives rise predominantly to singly charged ions of the protein molecules, which can then be measured in the mass spectrometer according to ion mass. Preferably, specially developed, highly sensitive MALDI time-of-flight mass spectrometers with a very simple design without reflectors are used for this purpose. Ions in the range of masses between 2000 and 20,000 daltons are measured.

Due to the particularly high detection sensitivity, the mass spectra of the microbe proteins are acquired by these time-of-flight mass spectrometers operating in linear mode. In other words, no energy-focusing reflector is used, although the mass resolution and mass trueness of the spectra from time-of-flight mass spectrometers operating in reflector mode is significantly better. As a result, the ion signals correspond, in the stated mass range, approximately to the envelopes of the isotope distributions, as illustrated in FIGS. 1 to 3.

The mass spectrum of a microbial isolate is the frequency profile of the mass values of the protonated molecular ions of the soluble cell components of the microbes. This nearly always involves mixtures of protein ions. Each pulse of laser light generates one single mass spectrum, which is measured in the time-of-flight mass spectrometer in less than 100 microseconds; but in the prior art, this spectrum must only contain signals with no more than a hundred ions per measuring cycle, i.e., every 0.25 nanoseconds at a sampling rate of 4 gigasamples/second. In order to obtain mass spectra with lower noise and a higher measuring range, it is usual to add together some hundreds or a few thousand of these individual mass spectra to form a sum spectrum. It is always this sum spectrum that is referred to by the term "mass spectrum of a microbe" or, more simply, "microbe spectrum". Thanks to the high rate of laser bombardment (at present, up to two kilohertz), it only takes a few seconds to acquire such a microbe spectrum. A sample support plate having 48, 96 or even 384 prepared samples can be measured automatically in less than half an hour.

The protein profile represented by each of these microbial spectra is highly characteristic of the particular microbe type because every species of microbe produces its own, genetically programmed proteins, each with characteristic masses. The frequency of the individual proteins in the microbes, inasmuch as they can be measured by mass spectroscopy, are also largely genetically programmed through the control of their production by other proteins, and only depend to a minor extent on the nutrient medium or on the maturity of the colony, provided they are not forming spores. The protein profiles are characteristic for microbes in rather the same way as fingerprints are for people. As a result it is possible to identify the microbes through a similarity analysis against reference spectra held in a reference library.

The spectra are evaluated using programs supplied by the manufacturers of the mass spectrometers. These programs are based on similarity analyses of a measured microbe spectrum against reference mass spectra from specially validated spectral libraries. A similarity coefficient is calculated for each reference spectrum. If the highest similarity coefficient found exceeds a specified similarity threshold, this constitutes unambiguous detection of the microbial species to which the corresponding reference spectrum belongs. Special similarity thresholds are used for the identification of family, genus or species.

Acquisition in accordance with the prior art yields neither a high concentration accuracy nor good reproducibility of the ion signals in the mass spectra. Low-level contamination of the sample preparations with salts, with substances having a high proton affinity, or with small quantities of other microbial species can sharply modify the mass spectra. For this reason, the prior art only assigns a very subsidiary role to the intensity of the ion signals in the calculation of the similarity coefficients. An improvement in the concentration accuracy and in the reproducibility of the mass spectra would significantly improve the method for identifying the microbes.

It should be stressed here that the mass spectrometric method has until now been applied only to the identification of microbes of unknown kind in samples. Usually the microbe isolates used for the preparation of these samples are obtained from well-separated colonies grown an agar plates. The identification of two, or at most three, microbial species in a mixture of these two or three microbial species has also been disclosed German Patent Application DE 10 2009 007 266 A1. It is, however, an as-yet unused strength of the mass spectrometric method that, under certain conditions, it can unambiguously and reliably detect the presence or absence of a specific microbial target species in rather more complex mixtures of five, ten or more microbial species. An improvement in the reproducibility and the concentration accuracy is, however, indispensable for this kind of rapid detection of specified microbes in foodstuffs, bathing water, stool or other samples.

Although the problem of mixture analysis has been described on the basis of the analysis of microbe proteins in linear time-of-flight mass spectrometers, it is not restricted to this. The problem also occurs in high-resolution MALDI time-of-flight mass spectrometers operated with reflectors for the analysis of proteins. Quite generally, therefore, a solution that will improve the analysis of mixtures is desirable for MALDI time-of-flight mass spectrometers.

An objective of the invention is to solve the MALDI dilemma, described above, between signal saturation and concentration accuracy, and to improve the reproducibility and also, if possible, the dynamic measuring range of the spectral acquisition in MALDI time-of-flight mass spectrometers.

SUMMARY OF THE INVENTION

The invention is based on acquiring multiple series of mass spectra from a mixture of analyte substances involving a step-wise increase in the energy density in the laser spot, and at the same time taking measures to solve the problem of signal saturation. In a first embodiment, the saturated signals in the mass spectrum with the highest energy density are replaced by extrapolations from unsaturated signals in mass spectra acquired at lower energy densities. This mass spectrum of the highest energy density with its replacements then represents the desired MALDI mass spectrum with the best concentration accuracy. In a second embodiment, the ion beam is defocused in stages, synchronously with the increase in the energy density, and is therefore attenuated at the detector sufficiently to prevent any signal entering saturation. In both of these embodiments it is possible to determine the factors by which the signal intensities rise as a result of the step-wise increase in the energy density of the laser spot, thus supplying further information about the analyte ions. Reference substances having a different rise factors may be employed for the optimum selection of the energy density for quantitative analyses.

This acquisition technique is particularly effective if the diameter of the laser spot is kept very small throughout, and only the total energy of the laser light shots is changed. At higher energy densities, those analyte substances that have lower proton affinity can also be ionized to a sufficient degree to be detected in mixtures. Because sample consumption is relatively small when small laser spots with a correspondingly high energy density are used, it is easy to acquire a large number of mass spectra without exhausting the sample.

Due to the highly non-linear growth in the ion yield in response to energy density, the application of this new acquisition technique is not trivial. The energy density in the laser spot should only be increased carefully, for instance by exactly 30 percent at a time. If the ion beam is not attenuated by defocusing, each ion signal will grow by a particular factor each time. It is not, however, the case that the factors by which each of the individual ion signals grows are all the same. The extrapolation of an ion signal must therefore normally proceed on the basis of at least two mass spectra in which the ion signals in question are not saturated, by determining the rise factor. If all those ion signals that are saturated in the mass spectrum with the highest energy density are now replaced by values obtained through extrapolation from ion signals acquired at lower energy densities, the mass spectrum obtained not only has an increased dynamic range of measurement, but also better reproducibility and concentration accuracy. The measuring range can be increased by a factor of a hundred or even a thousand, although the number of mass spectra acquired might only rise by a factor of between five and ten.

In the example of the analysis of microbe mixtures, it is possible in this way to obtain mass spectra with a good resolution of ion signals, even though many of the ion signals, often a large part of the mass spectrum, are already well into saturation at the highest energy density employed. At the highest energy density, however, proteins that have a low proton affinity are also ionized, and these proteins are therefore also visible in the mass spectra.

If the ion beam is attenuated through step-wise defocusing, it is necessary to determine the optimum degree of defocusing in each case by calibration. This method does not provide simultaneous improvement of the dynamic measuring range; as with standard methods, the dynamic measuring range must be increased for the mass spectra of each energy density by hundreds or thousands of individual spectra. The method does, however, also provide the additional information about the analyte substances. Here again, reference substances having different rise factors can be employed for the optimum and reproducible selection of the energy density for quantitative analyses.

These and other objects, features and advantages of the present invention will become more apparent in light of the following detailed description of preferred embodiments thereof, as illustrated in the accompanying FIGS.

DETAILED DESCRIPTION OF THE INVENTION

As has already been briefly described above, a first preferred embodiment of the invention includes acquiring a series of mass spectra of the mixture of analyte substances with step-wise increases in the energy density of the laser spots, and in replacing the signals that are saturated in the mass spectrum of the highest energy density by extrapolations from unsaturated signals in mass spectra acquired at lower energy densities. The mass spectrum from the highest energy density with its replacements then represents the desired MALDI mass spectrum for further evaluations.

Figure 1:
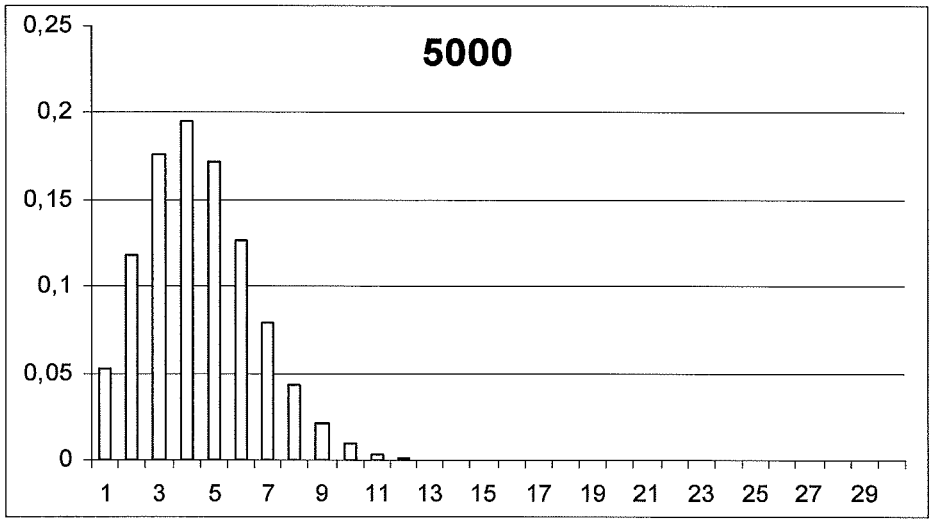
FIGS. 1 to 3 represent calculated isotopic distributions of three proteins with masses 5000, 12,000 and 20,000 daltons over the nominal masses. In a linear MALDI time-of-flight mass spectrometer, only ion signals in the form of the envelope are visible, since the mass resolution is inadequate to distinguish the signals from ions having the same nominal mass. In a time-of-flight mass spectrometer operating with a reflector that achieves a mass resolution of $R=m/\Delta m=40{,}000$, the ion signals of the nominal masses are resolved ($\Delta m$=full width at half-maximum of the ion signal for mass m).
Figure 2:
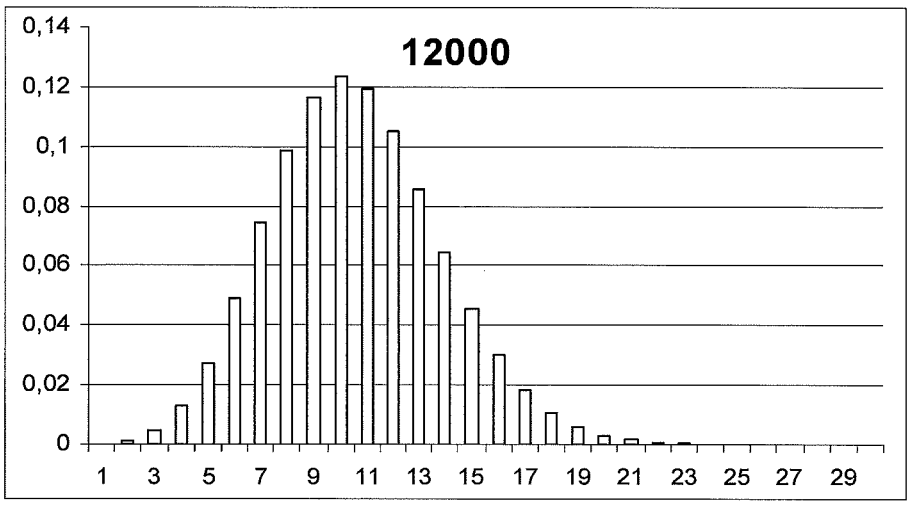
Figure 3:
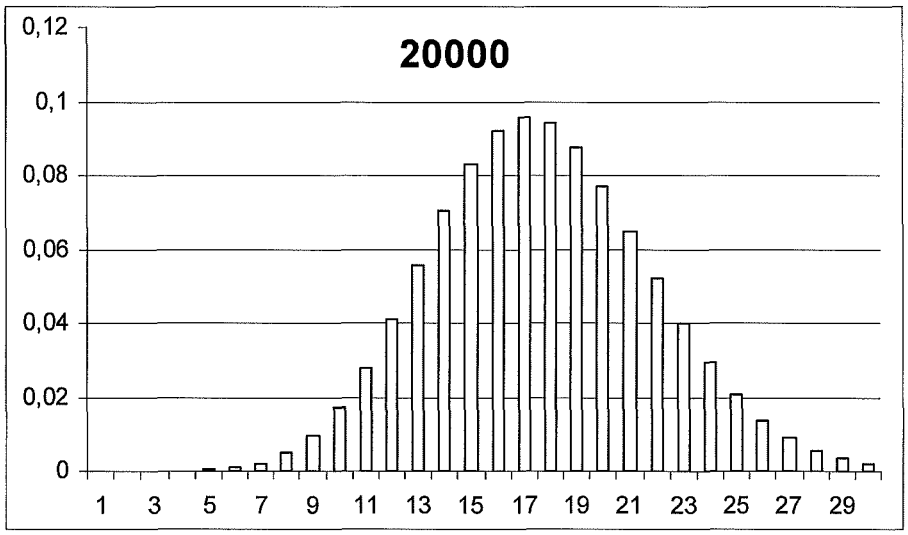
Figure 4:
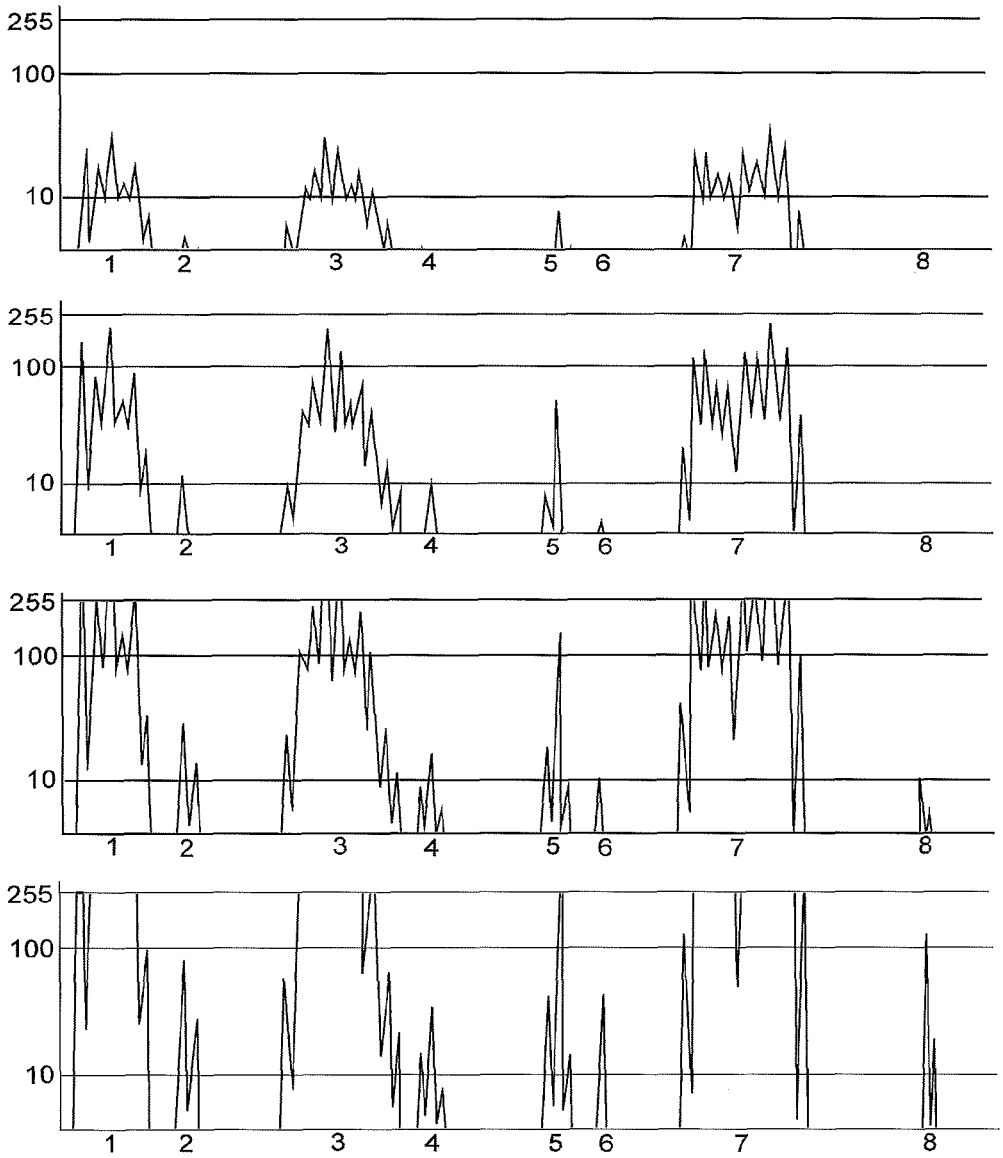
FIG. 4 illustrates schematically the principle of the stepwise increase of the energy density on equivalent extracts from four different mass spectra, where the energy density was increased by 30 percent between each acquisition. The ion beam was not defocused here, with the result that increasing numbers of ion signals enter saturation. For the sake of clarity, averaged individual spectra are shown here rather than added sum spectra, since otherwise intensities greater than 255 counts would be reached. The intensities are displayed logarithmically. The non-linear increase in the ion signals can be seen; rather than simply rising by about 30 percent each time, the factors are much greater, being between five and ten. The rise factor is not the same here for every ion species; in comparison with the other ion signals, the ion signals in groups about 6 and 8 rise much faster. According to the prior art, the second mass spectrum from the top would be ideal because no saturation occurs, but it does not show all the ion species.
Figure 5:
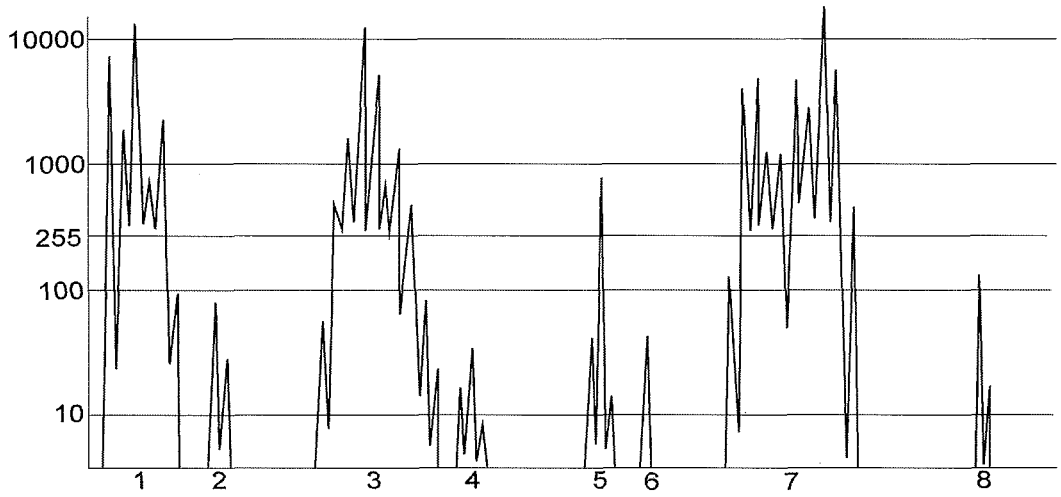
FIG. 5 illustrates the bottom mass spectrum from FIG. 4, but now those ion signals that are in saturation have been replaced by extrapolations from the ion signals of mass spectra that were acquired at lower energy densities. This mass spectrum not only has a dynamic range of measurement that is about 100 times greater, but also shows improved reproducibility. The acquisition technique also delivers further information about the proton affinity of the analyte ions, derived from the rise factors.

In order to extrapolate the intensities of the ion signals relatively effectively and simply, it is best to increase the energy density in relatively small steps, for instance by the same percentage in each case: 10, 20, 30, 40 or, 50 percent, i.e., by factors of 1.1, 1.2, 1.3, 1.4, or 1.5. The principle is illustrated in FIG. 4, which schematically reproduces extracts from four mass spectra in such a series. FIG. 5 illustrates the mass spectrum taken with the highest energy density, including its replacements by extrapolations. This mass spectrum represents the desired MALDI mass spectrum for further evaluations.

It is expedient here to adjust the ion detector, as described in the introduction, in such a way that an optimally wide dynamic measuring range is already achieved in the individual spectra; and it is essential to perform the adjustment in such a way that none of the ion signals from individual ions are lost.

If, with a particular measuring arrangement, it is found that the rise factors of the ion yields do not remain constant for a large majority of ion species when the energy density is increased in these percentage steps, but that they vary from one mass spectrum to the next in the series, it is possible to search for a function for the increase in the ion densities that yields a constant rise in the ion signals.

The individual mass spectra of the series are here formed in the usual way through the addition of a large number of individual spectra, for instance by summing between about 50 and 5000 individual spectra. A series of for instance, ten mass spectra with stepwise increasing energy densities, each with a thousand individual mass spectra can, if there are no other factors that limit the scan speed, be acquired in only about five seconds by a modern mass spectrometer using two thousand laser shots per second. The acquisition time is therefore not a limiting factor for this new acquisition technique. On the contrary, the achieved increase in dynamic measuring range saves time and reduces sample consumption.

A second embodiment of the invention similarly increases the energy density in individual steps, but here the ion beam is attenuated in equal steps by defocusing to such a degree that none of the ion signals enter saturation. The optimum degree of defocusing must be determined by a calibration process for each case. The ion beam in a time-of-flight mass spectrometer can be defocused somewhere on the flight path of the ions by an ion lens. The ion beam of a time-of-flight mass spectrometer is usually aimed at the detector in such a way that the detector is more or less fully illuminated. Defocusing therefore reduces the ion density at the detector, as required. This method does not provide simultaneous improvement of the dynamic measuring range. As with standard methods, the dynamic measuring range must be increased for the mass spectra of each energy density by hundreds or thousands of individual spectra, although it is not usually necessary for the mass spectra to achieve the same dynamic measuring range at every energy density.

This method is advantageous particularly when a mixture of substances is to be analyzed quantitatively with reproducibly consistent ionization. The optimum energy density for reproducible, quantitative analyses can then be determined by a spectrum series that does not demonstrate the full dynamic measuring range, making use of reference substances having different rise factors. Only then does the actual series of measurements for the analysis begin, using the energy density determined in this way. The optimum energy density can, for instance, be indicated by two reference substances having precisely the same intensity of ion signal (or some other specified ratio between the ion signals).

In both embodiments, these acquisition techniques are particularly effective if the diameter of the laser spot is kept small throughout, and only the total energy of the shots of laser light is changed. Only in this way is it possible to generate hot plasmas rich enough in protonating matrix substance ions to ensure that even those analyte substances whose proton affinity is low are sufficiently strongly ionized. With such an ion generation technique, sample consumption is extraordinarily small, so it is easy to acquire a large number of mass spectra without exhausting the sample.

Due to the highly non-linear growth in the ion yield in response to energy density, the application of these acquisition techniques is not trivial. The further description relates to the preferred embodiment, in which ion signals are extrapolated in order to replace saturated ion signals. For this purpose, the energy density in the laser spot is carefully increased in small, even steps, for instance by exactly 30 percent at a time. Any given ion signal then grows by about the same factor, which is typically somewhere between five and ten. But it is certainly not the case that the individual ion signals all grow by the same factor. In a preferred embodiment, an ion signal therefore has to be extrapolated from mass spectra in which the ion signals in question are not saturated, by determining the rise factor. The energy density must therefore be increased in steps to ensure that each of the ion signals is effectively measurable and not saturated in at least two of the acquired mass spectra, so that these ion signals can be used for the extrapolation. If all those ion signals that are saturated in the mass spectrum with the highest energy density are now replaced by values obtained through extrapolation from ion signals obtained at lower energy densities, the resulting mass spectrum not only has better reproducibility and higher concentration accuracy, but also has an increased range of measurement. In the schematic FIGS. 4 and 5, the measuring range is increased by a factor of one hundred, although for the series of four mass spectra, only four times as many mass individual spectra had to be measured. In practice it is possible to increase the measuring range by factors of a hundred to a thousand, using series of only between five and ten mass spectra. The techniques known to the prior art, on the other hand, require a thousand times as many individual mass spectra to be acquired in order to increase the dynamic measuring range by a factor of a thousand.

This embodiment employing individual rise factors for the individual ion species also delivers additional information about the proton affinities of the analyte substances. This opens up a new dimension of information, whose value cannot at present be assessed. In addition to the masses and frequencies of the analyte substance ions, it is also possible to store their proton affinities in a new kind of mass spectrum. Knowledge of proton affinities may turn out to be extremely valuable for bioinformatics.

In a simpler embodiment, it is also possible to perform the extrapolation using the same rise factors for all the ion signals. These rise factors can, for instance, be obtained from the averaged rises of the ion signals in the measured mass spectra. It is also possible to determine the average rise factors just once for a given rate of increase of energy density, and then to use it for all subsequently acquired series of mass spectra.

In a further embodiment, the reproducibility and the concentration accuracy can be further improved through non-linear extrapolation of the ion signals. This requires a finer gradation in the change of energy density from one mass spectrum to another in the series. If, for each ion signal, at least three mass spectra are available in which the ion signal concerned is not saturated, then a quadratic extrapolation can be performed from three ion signals, or a cubic extrapolation if four ion signals are available. If the individual mass spectra are composed from a very large number of individual mass spectra, for example a thousand for each, then the intensities of the ion signals will be precise enough to justify such a non-linear extrapolation.

The laser systems employed in MALDI time-of-flight mass spectrometers are usually operated in such a way that they continuously supply laser light flashes of the same energy. Attenuators are used to adjust the energy density in the laser spot. Different types of attenuator are available, but most of them allow the energy densities to be adjusted precisely, in general to within much better than one percent.

Nowadays MALDI time-of-flight mass spectrometers are increasingly required to quantify specific substances, such as proteins, in relation to an added reference substance. Until a few years ago there was no solution to this task because the process of MALDI ionization also not be controlled. Nowadays, on the other hand, thin-layer preparations of matrix substances, such as HCCA (α-cyano-4-hydroxycinnamic acid), on sample support plates are commercially available, and these offer good reproducibility in the MALDI process. These thin layers are only about one micrometer thick, and are applied very evenly to small sample areas with diameters of about 0.8 millimeters. A small quantity of aqueous solution of the protein mixture that is to be analyzed is applied to the thin layers, and the proteins are adsorbed by the small matrix crystals. After a short period, the supernatant liquid can be drawn off. A microliter of acetonitrile is then applied to the dried sample preparation, which causes the small matrix crystals to begin to dissolve. Subsequent drying embeds the protein molecules evenly within the small matrix crystals. Evaluating the protein signals in the mass spectrum with the aid of a reference substance yields quite good quantification. The disadvantage of this method, however, is that the ionization intensity of the plasma in the laser spot cannot be set reproducibly. In techniques used until now, the energy of the laser is simply adjusted in such a way that none of the signals are driven into saturation. Depending on the nature of the mixture of analyte substances, however, this can mean that the temperature or proton donor density (or Gibbs free enthalpy) in the plasma is higher one time and less high another time, thus resulting in different intensities of ionization of the individual analyte substances in the mixture.

This method of quantitative analysis can be improved through the application of this invention. For this purpose, not just one reference substance, but at least two reference substances with different protein affinities are added. The ratio between the ion signals from these reference substances can then be used to determine a measure of the proton density, the ionization temperature or the free enthalpy in the plasma of the laser spot, and this can be taken into account in the quantitative evaluation. It is also possible, through immediate evaluation of the mass spectra, to adjust the energy density in the laser spot so that a particular, specified ratio between the ion signals of the reference substances is obtained. Only those mass spectra that are acquired at this energy density are then used for the quantitative analysis.

The development of transient recorders is not only providing faster scanning rates, but is also tending towards greater data depths for the analog-to-digital conversion. Data depths of 10 or even 12 bits are in sight. When these transient recorders come onto the market, the acquisition technique provided here will not lose any of its value.

The acquisition technique for MALDI time-of-flight mass spectrometers can be applied both to high-resolution time-of-flight mass spectrometers operating in reflector mode as well as for lower-resolution time-of-flight mass spectrometers operated in linear mode. This acquisition technique is always advantageous when mixtures of analyte substances are to be analyzed. It is of particular advantage when a high dynamic measuring range or good reproducibility of the mass spectra is important. The possibility of obtaining information about the proton affinity here opens up entirely new dimensions, whose value cannot at present be assessed.

Although the present invention has been illustrated and described with respect to several preferred embodiments thereof, various changes, omissions and additions to the form and detail thereof, may be made therein, without departing from the spirit and scope of the invention.

What is claimed is:

1. A method for acquiring time-of-flight mass spectra of analyte substances with ionization by matrix assisted laser desorption using a laser system, comprising acquiring groups of mass spectra using the laser system, wherein an energy density in the laser spot is step-wise increased between acquisitions;

replacing saturated ion signals in the mass spectrum of the group obtained with the highest energy density by extrapolated values from unsaturated ion signals in mass spectra of groups acquired at lower energy density; and forming the mass spectrum from the group obtained at highest energy density with its replacement of saturated ion signals by extrapolation values.

2. The method of claim 1, wherein the energy densities are increased in equal steps.

3. The method of claim 2, wherein the energy densities are increased by the same percentage each time.

4. The method of claim 3, wherein the percentage lies between 10 and 50 percent.

5. The method of claim 1, wherein the energy density is increased by steps producing an increase of the ion signal in equal proportions, resulting in simple extrapolation.

6. The method of claim 1, wherein at least two unsaturated signals of the same ions from mass spectra acquired at lower energy density are used for the extrapolation of an ion signal.

7. The method of claim 6, wherein linear extrapolation is used.

8. The method of claim 6, wherein a non-linear extrapolation based on at least three unsaturated signals is used.

9. The method of claim 1, wherein an extrapolation using the same rise factor is performed for all the ion signals.

10. The method of claim 1, wherein each mass spectrum is a summation of many individual mass spectra.

11. The method of claim 10, wherein each mass spectrum is a summation of the same number of individual mass spectra.

12. The method of claim 10, wherein each mass spectrum is a summation of between 50 and 5000 individual mass spectra.

13. The method of claim 1, wherein the sample preparations are bombarded with flashes of laser light in which the diameter of the laser spot is at most 20 and preferably 10 micrometers.

14. A method for acquiring the time-of-flight mass spectra of analyte substances with ionization by matrix assisted laser desorption using a laser system, wherein a series of mass spectra is acquired using the laser system, wherein an energy density in the laser spot is step-wise increased between the acquisitions, and the ion beam in the time-of-flight mass spectrometer is attenuated in equal steps by defocusing to such an extent that the ion signals of each of the mass spectra do not show saturation.

15. The method of claim 14, wherein an ionization temperature is determined by measuring the ratio of the ion signals from two different reference substances.

16. The method of claim 15, wherein the ionization temperature is taken into account when evaluating the mass spectra for quantitative analyses.

17. The method of claim 15, wherein for quantitative analyses, the energy density in the laser spot is adjusted by means of the ratio of the ion signals of two different reference substances.

* * * * *